US005421473A

United States Patent [19]

McCrossen

[11] Patent Number: 5,421,473

[45] Date of Patent: Jun. 6, 1995

[54] HEAT RESISTANT PLASTICS CONTAINER CLOSURE

[75] Inventor: Peter C. McCrossen, Eden, Australia

[73] Assignee: Radley Valley Pty Ltd., Mordialloc, Australia

[21] Appl. No.: 185,840

[22] PCT Filed: Jul. 23, 1992

[86] PCT No.: PCT/AU92/00374

§ 371 Date: Jan. 24, 1994

§ 102(e) Date: Jan. 24, 1994

[87] PCT Pub. No.: WO93/01988

PCT Pub. Date: Feb. 4, 1993

[51] Int. Cl.[6] ..... B65D 45/30

[52] U.S. Cl. ..... 220/319; 220/276; 292/256.6; 292/256.73

[58] Field of Search ..... 220/319, 276; 215/276, 215/283, 252, 256; 292/256.6, 256.63, 256.67, 256.71, 256.73

[56] References Cited

U.S. PATENT DOCUMENTS 2,562,111 7/1951 Michel ..... 220/319 X

*Primary Examiner*—Allan N. Shoap
*Assistant Examiner*—Nova Stucker
*Attorney, Agent, or Firm*—Thomas R. Vigil; James P. Hanrath

[57] ABSTRACT

A plastics container (10) for hermetically sealed unrefrigerated storage of perishable food that is capable of retaining the hermetic seal during steam retort cooking and sterilizing at temperatures up to 130° C. The container has a body (12) and cover (16) of a lightweight, disposable nature made from thermoformable plastics barrier sheet capable of prolonged resistance to transmission of oxygen, other gases and water vapor. The container and lid have flange portions (14, 18) that are retained in contact by an injection moulded thermoplastics reinforcing clamp ring in two pieces, a plug half (24) and a socket half (26) that twist-to-lock together in screw thread manner. The clamp ring parts are preferably of polypropylene and moulded with structural cross-sectional thicknesses (t1, t2, FIGS. 4, 5) at least twice the thickness of that of the body sheet.

23 Claims, 5 Drawing Sheets

HEAT RESISTANT PLASTICS CONTAINER CLOSURE

BACKGROUND OF THE INVENTION

The invention relates to a plastics container for food. It more particularly relates to a mass produced thermoplastics container of the type used for storage at shelf temperature (i.e. non-refrigerated storage) of foods requiring heat processing. In particular steam retort sterilization as part of the packaging and subsequent processing and which may be used ultimately after directly heating the contents in the container in a microwave oven.

The invention provides the public a useful choice in selecting foods in convenience packaging wherein the package can provide the cooking vessel and even the eating receptacle for the consumer. It provides a disposable hermetically sealed container package which can be heated in a microwave oven and, if required, eaten hot direct from the container and moreover, if to be only partially consumed, the container may be tightly reclosed repeatedly after being opened, in which state it may be preserved for some time under refrigeration.

The container of the invention is formed from thermoplastics barrier sheet, that is, an extruded multilayer sheet that contains one or more layers highly resistant to the permeation of at least oxygen and water vapor despite the overall thinness of the sheet used for forming the container.

Where low acid foods are to be preserved in a shelf stable package using a container of the type of the invention, heating in a steam pressurized retort is required to cook the food during the course of a heat processing cycle that ensures a temperature high enough (e.g. up to 130° C.) and a time long enough to ensure that "commercial sterility" of the contents results. The package must remain hermetically sealed during and following the heat process to ensure food spoilage organisms do not enter the package. The package must remain sealed hermetically until the time it is deliberately opened for consumption, and must remain effectively sterilized of pathogenic food spoilage organisms regardless of whether the food is served heated or not.

During heat processing in a retort, even of the balanced pressure type, it is virtually inevitable that some differential pressure will occur between the pressurized interior of the retort and the package interior. The inevitable pressure induced stresses on a container in such an environment when accompanied by at least the degree of temperature induced softening unavoidable in the case of a thermoplastics container is not conducive to ensuring that a container of the general type would not leak, especially considering the relatively thin (typically 200 to 1200 micron) thermoformable barrier sheet used for the body and cover of the package. For this reason the container of the invention discloses an effective while relatively economical clamp ring to enable the package as a whole to resist the stresses imposed while heat processing and, at the same time, providing tamper evidence, ease of opening, microwave oven heating possibility (i.e. non-metallic construction) and repeated resealability all in an economical throw-away package having utility at all phases of the production, distribution, preparation and serving phases.

SUMMARY OF THE INVENTION

The invention consists of plastics packaging container for hermetically sealed unrefrigerated storage of perishable food adapted to retain the hermetic seal during retort sterilization and adapted for manual opening and reclosing microwave oven heating of the food in the container, said container comprising:

(a) a body formed from thermoplastics barrier sheet and having an open top and a radially outwardly flanged lip circumferentially defining said open top;

(b) a substantially planar or axially stepped cover formed from thermoplastics barrier sheet of thickness 1 to 1.5 mm and having a peripherally and radially outwardly extending flange portion adapted to mate in face-to-face relationship with the said outwardly flanged lip of the body; and (c) an injection molded thermoplastics reclosable reinforcing clamp ring comprising a plug half portion and a mating socket half portion wherein one said half portion is adapted to house and retain the flange portion of the body and the other half portion is adapted to house and retain at least the flange portion of the cover and whereby the said half portions are provided with mating engagement means adapted to tighten said flange portions of the body and cover into hermetic sealing contact upon axial rotation of one half portion of the clamp ring with respect to the other and wherein each of the half portions is formed from a thermoplastics material with minimum structural cross-sectional thickness at least twice the thickness of the body barrier sheet and the tightened clamp ring is adapted to retain the hermetic sealing contact between the said flange portions during a heating and cooling cycle in a steam pressurized retort reaching temperatures of 130° C.

Preferably the socket half portion is in contact with and retains the cover and the socket half portion extends radially inwardly not more than the inward edge of the flange portion of the cover.

Preferably the cover portion has an inwardly directed step immediately radially inwardly of the flange portion that stiffens the cover and assists it locate in the body opening.

In one preferred form the socket half portion has a wedge shaped portion engaging the inwardly directed step, effective to tightly compress the cover in a radially outward direction against the lip of the body opening immediately inward and downward of the radially inner extent of the flange defining the lip of the open top of the body.

Preferably the container further includes a gasket adapted to lie between at least the flange portions of the body and cover, the gasket being softer or more compressibly deformable than the barrier sheet material comprising the receptacle and cover.

Further preferred features include:

The barrier sheet comprises at least one polycarbonate layer and at least one amorphous polyethylene terephthalate layer or, alternatively, the barrier sheet may comprise at least two layers of polypropylene and at least one layer of ethylene vinyl alcohol.

When the amorphous polyethylene terephthalate layered structure is preferred it comprises 90% of a 200 to 1200 micron total layer thickness of the body. This provides excellent resistance to heat induced distortion.

The clamp ring parts may be mozlded of polypropylene. The socket half portion may be securely bonded to the flange of the cover. This may be achieved by friction welding or other suitable method and makes the cover and socket easier to apply, remove and replace.

Similarly the plug half portion may be preferably securely bonded to the flange of the body.

BRIEF DESCRIPTION OF THE DRAWINGS

The invention is further described by way of a particularly preferred example of it and other possible embodiments with reference to the accompanying illustrations in which.

DETAILED DESCRIPTION OF THE PREFERRED EMBODIMENT

Figure 1:
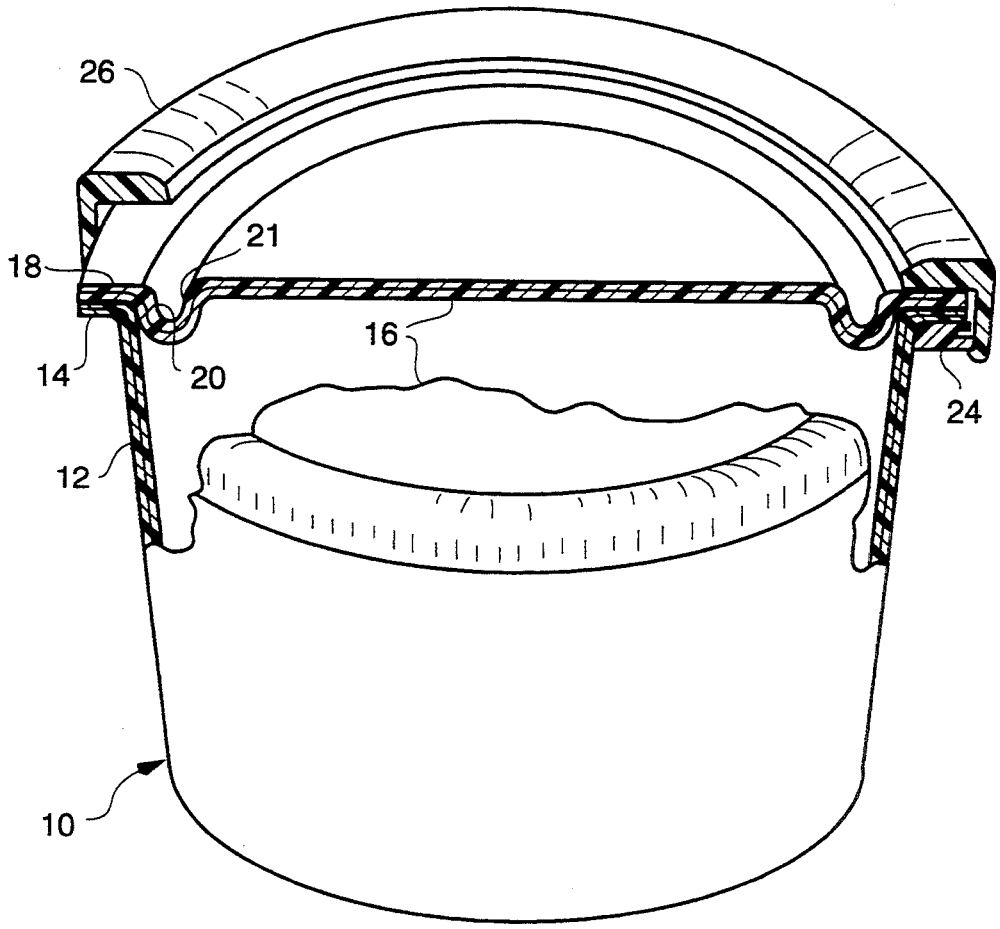
FIG. 1 is a part cut-away perspective view of a container according to the invention.
Figure 2:
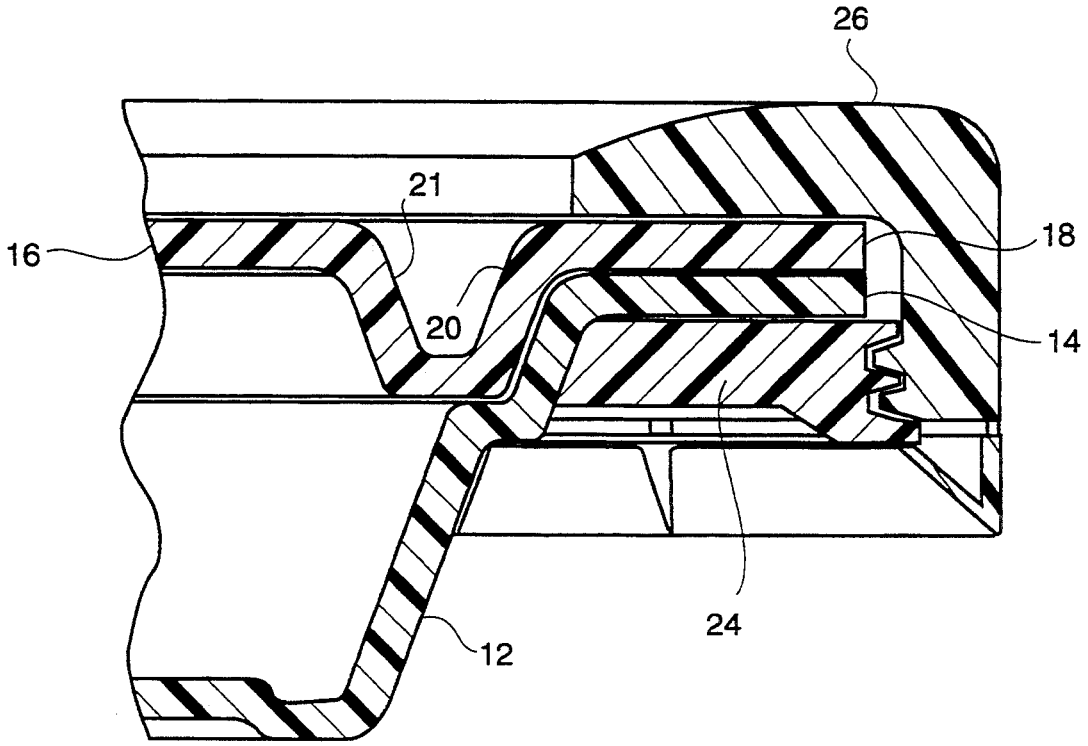
FIG. 2 is an enlarged cross-section of a fragment of a container according to the invention.
Figure 3:
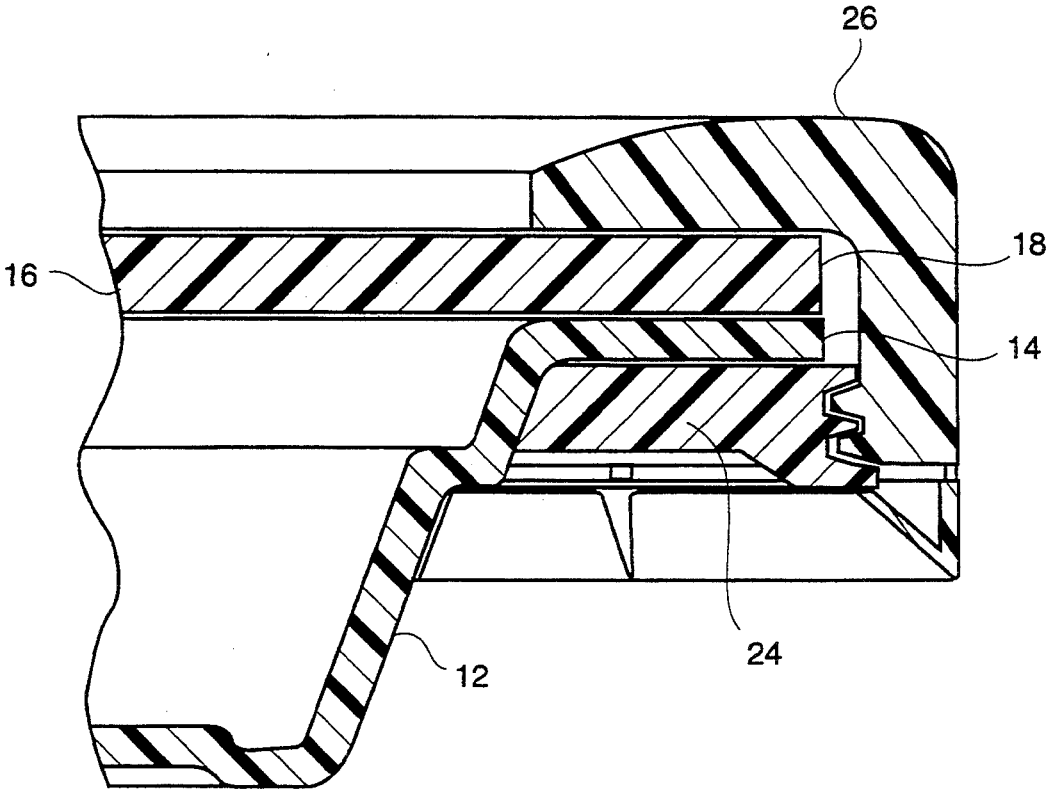
FIG. 3 is a similar view to FIG. 2 showing an alternative embodiment of the invention.

With reference to FIGS. 1, 2 and 3 the container 10 comprises a cup or bowl like body or receptacle 12 for food with a full diameter top opening bounded by a radially outwardly extending flange 14 encompassing the full periphery of the opening. The container further comprises a cover 16 (or lid) adapted to close the opening of the receptacle 12 when a flange portion 18 of the cover 16 abuts the flange 14 of the receptacle. With reference to FIG. 3, the flange 18 is to be taken to extend inwardly to the point where the flange 14 of the receptacle and the cover diverge from being mutually adjacent. The cover may be provided (FIGS. 1 and 2) with a step 20 axially inwardly directed with respect to the closed receptacle and the substantially planar central portion of the lid 16 may have at least one further step 21 serving to either increase or decrease the internal capacity of the closed container although not necessarily provided for that purpose alone. Although only illustrated in the FIG. 6 embodiment, the flanges 14 and 18 when abutted may entrap a gasket or wad material 22 of a more flexible thermoplastics composition than that of the flanges, the gasket being to enhance the hermetic sealability of the closed package. Such a gasket is not illustrated in FIGS. 1, 2 and 3 but may be provided in any embodiment of the invention.

FIGS. 2 and 3 more clearly illustrate that the flange 14 of the receptacle 12 has abutting its periphery and underside a ring-shaped thermoplastics injection molded plug 24 with a male thread that may be a square or buttress thread around its periphery, the plug thread extending radially outwardly beyond the outside edge of the flange 14. The plug 14 may be permanently attached to the flange 14 of receptacle 12 by any suitable method such as adhesive bonding, friction welding or ultrasonic welding although alternatively it maybe a close push-in, but removable fit.

The flange 18 of the cover 16 has abutting its periphery and outside edge of its surface facing upward (as illustrated) a ring-shaped thermoplastics injection moulded socket 26, the socket integrally comprising a radially extending portion (lying generally co-planar with respect to the flange 18) meeting an axially downwardly extending skirt portion, the inside surface of which has moulded therein a female thread adapted to mate with the above-mentioned male thread around the periphery of the plug 14.

As with the receptacle and plug, the socket 26 and cover 16 may be permanently bonded together although the disclosed arrangement could still function even if the socket 26 were not permanently attached to the cover 16 but merely retained the cover such as by being a snap-in fit in an accommodating recess (not illustrated) in the socket 26.

Both the threads of the socket and plug may be multi-start threads or even rudimentary thread-like projections in either case requiring only a partial revolution rotation between a disengaged position to a fully tightened position of the cap and socket.

The receptacle 12 and cover 16 are constructed of a thermoplastics multi-layer sheet having good barrier properties, making the container suitable for preservation of oxygen-sensitive foods for extended periods. The multi-layer barrier sheet is selected to protect the products against loss of flavour and loss of other quality attributes due to transmission of moisture and various gases in either direction through the wall of the container.

A particularly preferred barrier sheet comprises a co-extruded sheet comprising at least three layers, each surface layer being of amorphous polycarbonate having a melt flow index of 8–12 g/10 min (ASTM Method D1238 condition 0) and the enclosed third layer being of amorphous polyethylene terephthalate homopolymer or co-polymer ("APET"), having intrinsic viscosity in the range 0.6 to 0.05 (Goodyear method No. R-100f)> The total thickness of the layers may be typically in the range 200 to 1200 microns in which typically the APET layer comprises about 90% of the total thickness. The barrier sheet may comprise additional layers.

An alternative barrier sheet of slightly lower temperature resistance is a 5-layer co-extruded thermoplastics structure having internal and external layers of polypropylene contacted by layers of adhesive, each adhesive layer in turn contacting a relatively thin enclosed layer of ethylene vinyl alcohol. This material provides an excellent barrier to permeation transfer of water vapor, oxygen, nitrogen and carbon dioxide gases.

The injection molded plug and socket parts of the clamp ring are preferably formed of polypropylene, but may include more or less heat resistant olefin type thermoplastics such as polybutylene or high density polyethylene. The minimum cross-sectional dimensions of the clamp ring parts 24, 26 are chosen such as to be effective to retain adequate compressive clamping force between the flanges 14, 18 during heat processing of the sealed and filled package 10. The clamp ring parts' dimensions are chosen according to the intended selected thermoplastics material and the heat processing requirement for the package, given that for economy of packaging cost it is usual to select the minimum thickness of barrier sheet adequate for a required duty. Thus the clamp ring material and dimensions are chosen to be heavy enough to reinforce the relatively thin barrier sheet at the Join of the closure.

A food product comprising for example low acid crustacean meats would require a high temperature long exposure retort process to ensure commercial sterility. For a relatively more acidic vegetable product a slightly lower temperature shorter time retort process would suffice to attain the same level of assurance of sterility. Further down the scale of severity of the heat processing requirements, a highly acid fruit would merely require hot filling without subsequent retorting, typically at 95° C. approximately. The cross-sectional thickness of the clamp ring parts is chosen depending upon the degree of severity of the heat process which the closure is to withstand in combination with the nature of the preferred material from which the clamp ring parts is to be molded. Generally the minimum structural cross-sectional thickness "11" (FIG. 4) of the socket 26 is at least twice the thickness of the flange 18 of the cover or say, 3 mm. The structural thickness "12" (FIG. 5) of the plug 24 is at least twice the thickness of the flange 14 of the receptacle 12, or, say, 2.4 mm.

Figure 6:
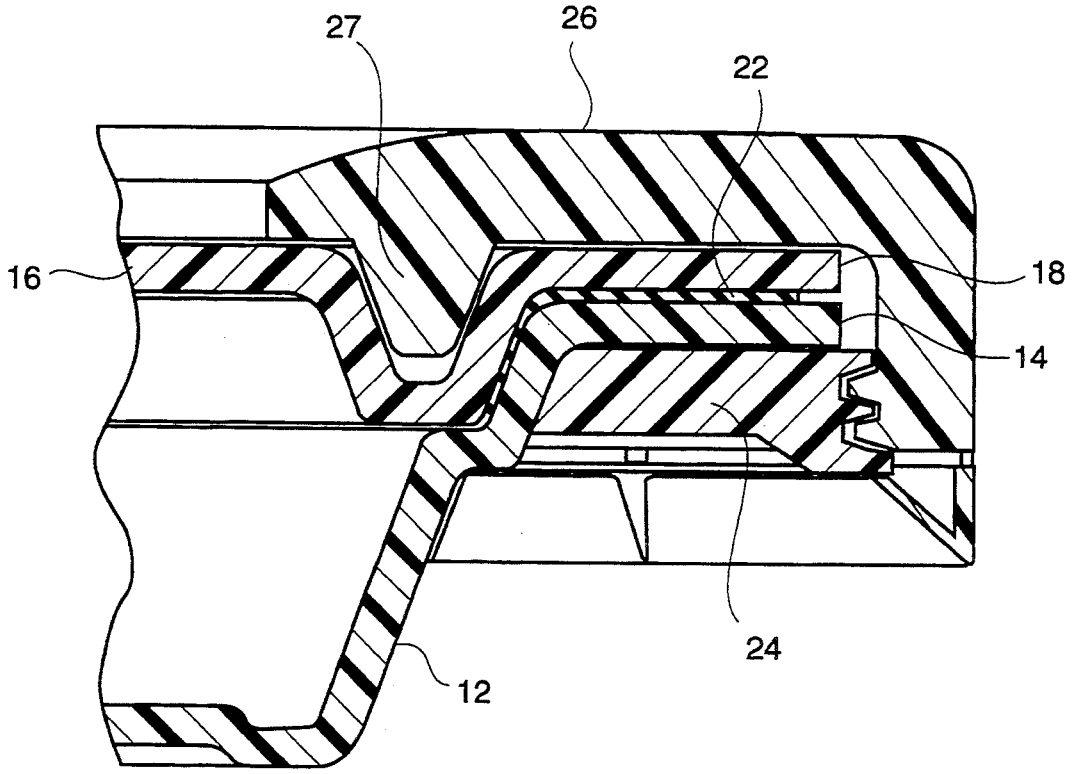
FIG. 6 is an enlarged cross-section of a fragment of an alternative embodiment of container according to the invention.

With reference to FIG. 6 an alternative embodiment of the socket 26 is shown having a wedge-shaped cross-section 27 inwardly directed engagement to wedge outwardly against the wall of the receptacle 12 Just inwardly of the flanged lip. This action provides a greater compressive force between the mating parts of the receptacle and cover and the likelihood of thereby tightening the hermetic seal achievable may be further enhanced by the inclusion of the gasket 22 not only between the flanges 14, 18 but also between the abutting portion of the step 20 of the lid and the corresponding portion of the receptacle just inward of the open top that abuts the step in the lid.

Compare however the essentially flat cover 16 of the embodiment of the invention shown in FIG. 3. The FIG. 3 embodiment may depart from flatness if desired by having a downwardly extended periphery (not illustrated) adapted to locate on the outside diameter of flange 14 upon assembly the cover 16 to the receptacle 12. Generally however the location of the plug to socket portions would provide adequate location.

Any version of cover other than an absolutely flat disc is formed by any of the so termed thermoforming processes generically applicable to sheet materials that include softening of the sheet followed by vacuum forming, (air) pressure forming or cuspation forming. Similarly the body 12 is formed by any suitable variant of a thermoforming process. Following thermoforming, the container and cover blanks would usually be die cut from the parent barrier sheet. It is preferred that the flange portions 14 and 18 be hot die compressed as an adjunct to the thermoforming process in order to improve the flatness and thickness control accuracy.

The clamp-ring parts 24 and 26 are formed by injection molding, this being a process suited to producing good dimensional tolerance in mass produced parts.

Figure 4:
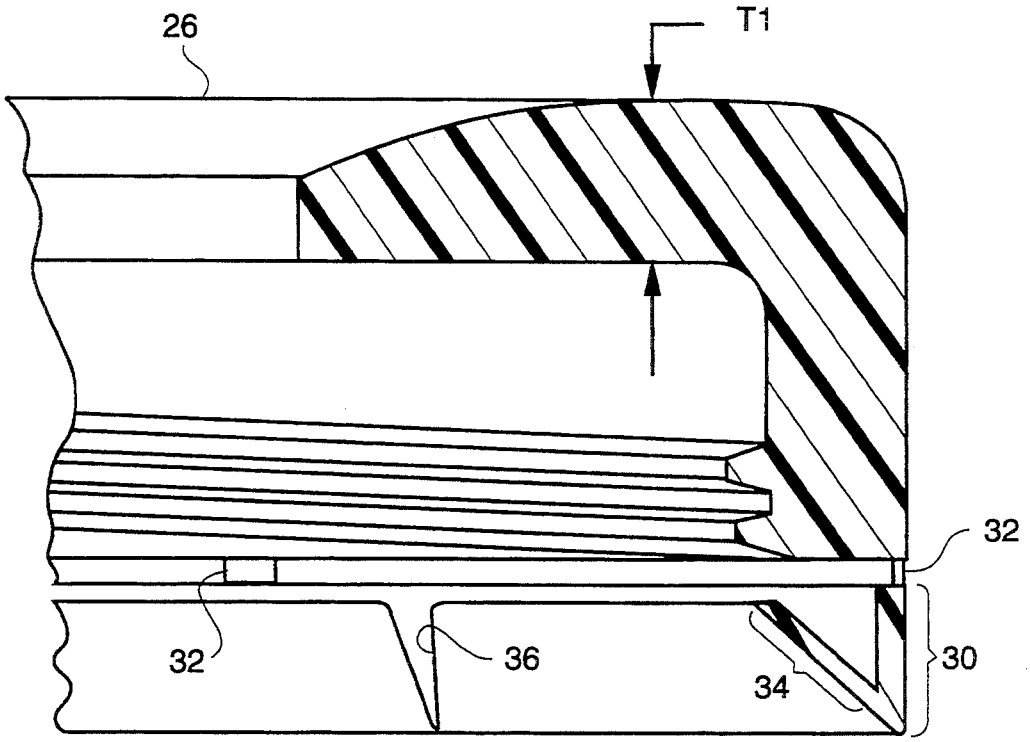
FIG. 4 is a fragmental part-cross-section to a more enlarged scale of a socket half portion of the reclosable re-inforcing clamp ring component of a container according to the invention.
Figure 5:
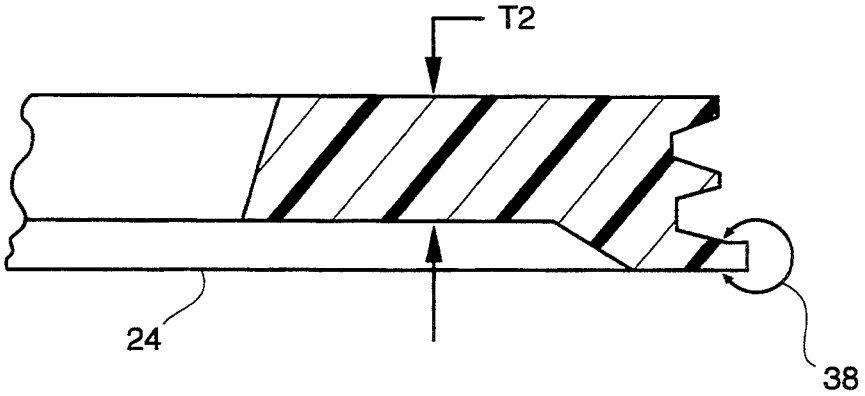
FIG. 5 is a fragmented part-cross-section to a more enlarged scale of a plug half portion of the reclosable reinforcing clamp ring component of a container according to the invention.

The clamp ring may have a tamper evident arrangement of any suitable type. As best seen in FIGS. 4 and 5, one example comprises a skirt-ring 30 attached to the socket 26 by spaced apart frangible lugs 32 around the periphery. Inwardly angled lip 34 has notches 36 spaced around its circumference. The lip 34 deflects over the protuberance 38 of the plug 24 on first screwing up the socket and plug together. Unscrewing results in the lugs 32 breaking to provide tamper evidence.

The gasket 22 (FIG. 6) when used, may be any suitable composition. One form may comprise a 60–95% polybutylene terephthalate blend with 40–45% polyethylene terephthalate, each comprising about 50 to 90 mole % of dicarboxylic acid.

I claim:

1. A disaposable packaging container said container comprising:

(a) a body, which has been transformed from a thermoplastics barrier sheet and and which has an open top and a radially outwardly flanged lip circumferentially defining said open top;

(b) a cover having a peripherally and radially outwardly extending flange portion adapted to mate in face-to-face relationship with said outwardly flanged lip of the body, said cover having an inwardly directed step radially inwardly of the flange portion, and (c) a reclosable reinforcing clamp ring comprising a plug half portion and a mating socket half portion wherein one said half portion is adapted to house and retain the flange portion of the body and the other half portion is adapted to house and retain at least the flange portion of the cover, the socket half portion having a wedge shaped portion engaging the inwardly directed step, effective to compress the cover in a radially outward direction against the receptacle lip, and said half portions being provided with mating engagement means adapted to tighten said flange portions of the body and cover into hermetic sealing contact upon axial rotation of one half portion of the clamp ring with respect to the other.

2. A container as claimed in claim 1 in which the container further includes a gasket adapted to lie between at least the flange portions, the gasket being more compressibly deformable than the barrier sheet material comprising the body and cover.

3. A container as claimed in claim 1 in which the cover comprises a barrier sheet having a thickness of between 1.0 to 1.5 mm and includes at least one polycarbonate layer and at least one amorphous polyethylene tertphthalate layer.

4. A container as claimed in claim 1 in which the cover comprises a barrier sheet having a thickness of between 1.0 to 1.5 mm and includes at least two layers of polypropylene and at least one layer of ethylene vinyl alcohol.

5. A container as claimed in claim 1 in which the clamp ring parts are molded of polypropylene.

6. A container as claimed in claim 1 in which the socket half portion is securely bonded to the flange of the cover.

7. A container as claimed in claim 1 in which the plug half portion is securely bonded to the flange of the body.

8. A container as claimed in claim 1, wherein each of the half portions are formed from a thermoplastics material with minimum structural cross-sectional thickness of at least twice the thickness of the body barrier sheet and the tightened clamp ring is adapted to retain the hermetic sealing contact between said flange portions during a heating and cooling cycle in a steam pressurized retort reaching temperature of 130° C.

9. A container as claimed in claim 1 wherein the reinforcing clamp ring includes a tamper ring.

10. A container as claimed in claim 1 in which the cover comprises a barrier sheet having a total layer thickness of between 200 to 1200 microns and includes at least one polycarbonate layer and at least one amorphous polyethylene terephthalate layer.

11. A container as claimed in claim 10 wherein the amorphous polyethylene terphthalate layer comprises 90% of the 200 to 1200 micron total layer thickness.

12. A disposable packaging container, said container comprising:

a body, which has been thermoformed from a thermoplastics barrier sheet, having a cup portion with an open top and a circular radially outwardly extending flanged lip with an inward edge circumferentially joined to said open top, a circular substantially planar cover, also thermoformed from a thermoplastics barrier sheet, including a flange portion adapted to mate in face-to-face relationship with said outwardly flanged lip of the body to form a composite lip, and a reclosable reinforcing clamp ring including a tamper ring adapted to abut against the composite lip and to separate from the clamp ring when the container is opened, the clamp ring comprising a plug half portion and a mating socket half portion wherein one said half portion is adapted to house and retain the flange portion of the body and the other half portion is adapted to house and retain at least the flange portion of the cover and said half portions being provided with mating engagement means adapted to press the flange portion of the body and cover together upon axial rotation of one half portion of the clamp ring with respect to the other.

13. A container as claimed in claim 12 wherein each of the half portions is formed from a thermoplastics material with minimum structural cross-sectional thickness at least twice the thickness of the body barrier sheet and the clamp ring, when tightened, is adapted to facilitate and retain hermetic sealing contact between said flange portions during a heating and cooling cycle in a steam pressurized retort reaching temperatures of 130° C.

14. A container as claimed in claim 12 in which the socket half portion is in contact with and retains the cover.

15. A container as claimed in claim 12 in which the socket half portion extends radially inwardly not more than the inward edge of the flange portion of the cover.

16. A container as claimed in claim 12 wherein the tamper ring is formed as an integral part of the socket half portion.

17. A container as claimed in claim 12 in which the container further includes a gasket adapted to lie between at least the flange portions, the gasket being more compressibly deformable than the barrier sheet material comprising the body and cover.

18. A container as claimed in claim 12 in which the barrier sheet comprises at least two layers of polypropylene and at least one layer of ethylene vinyl alcohol.

19. A container as claimed in claim 12 in which the clamp ring parts are moulded of polypropylene.

20. A container as claimed in claim 12 in which the socket half portion is securely bonded to the flange of the cover.

21. A container as claimed in claim 12 in which the plug half portion is securely bonded to the flange of the body.

22. A container as claimed in claim 12 in which the barrier sheet comprises at least one polycarbonate layer and at least one amorphous polyethylene terephthalate layer.

23. A container as claimed in claim 12 in which the amorphous polyethylene terephthalate layer comprises 90% of the total layer thickness.

* * * * *

UNITED STATES PATENT AND TRADEMARK OFFICE

CERTIFICATE OF CORRECTION

PATENT NO. : 5,421,473

DATED : June 6, 1995

INVENTOR(S) : Peter C. McCrossen

It is certified that error appears in the above-indentified patent and that said Letters Patent is hereby corrected as shown below:

Column 1, line 38, "130°C." should be --130°C--.

Column 5, line 4, "Join" should be --join--.

Column 5, line 14 "95°C." should be --95°C--.

Column 5, line 28, "Just" should be --just--.

Column 5, line 44, "assembly the" should be --assembly of the--.

Column 6, line 11, "transformed" should be --thermoformed--.

Signed and Sealed this

Twelfth Day of September, 1995

*Attest:*

Bruce Lehman

BRUCE LEHMAN

*Attesting Officer*

*Commissioner of Patents and Trademarks*